US009030459B2

(12) United States Patent
Jang et al.

(10) Patent No.: US 9,030,459 B2
(45) Date of Patent: May 12, 2015

(54) BACK LIGHT UNIT AND DISPLAY DEVICE INCLUDING THE SAME

(75) Inventors: Jin-Won Jang, Asan-si (KR); Min-Soo Choi, Asan-si (KR); Young Sup Kwon, Gwangmyeong-si (KR)

(73) Assignee: Samsung Display Co., Ltd. (KR)

( * ) Notice: Subject to any disclaimer, the term of this patent is extended or adjusted under 35 U.S.C. 154(b) by 597 days.

(21) Appl. No.: 13/240,228

(22) Filed: Sep. 22, 2011

(65) Prior Publication Data

US 2012/0256894 A1 Oct. 11, 2012

(30) Foreign Application Priority Data

Apr. 6, 2011 (KR) ..... 10-2011-0031758

(51) Int. Cl.

| | |
|---|---|
| ***G09G 5/00*** | (2006.01) |
| ***H05B 33/08*** | (2006.01) |
| ***G09G 3/34*** | (2006.01) |
| ***G09G 3/36*** | (2006.01) |

(52) U.S. Cl.

CPC ..... *H05B 33/0857* (2013.01); *H05B 33/0815* (2013.01); *H05B 33/0827* (2013.01); *G09G 3/342* (2013.01); *G09G 3/3648* (2013.01); *G09G 2320/0233* (2013.01); *G09G 2320/064* (2013.01); *G09G 2330/021* (2013.01)

(58) Field of Classification Search

CPC ..... H05B 33/0857; H05B 33/0866; H05B 33/0887; H05B 33/0827; H05B 33/0818; H05B 33/0815; G09G 3/342; G09G 3/3648; G09G 2330/021; G09G 2320/0233; G09G 2320/064

USPC ..... 315/291, 307, 308, 312, 192, 297; 345/211–214, 102

See application file for complete search history.

(56) References Cited

U.S. PATENT DOCUMENTS

| | | | | |
|---|---|---|---|---|
| 7,196,483 | B2 | 3/2007 | Wey et al. | |
| 7,317,403 | B2 | 1/2008 | Grootes et al. | |
| 7,714,517 | B2 | 5/2010 | Shih et al. | |
| 2006/0261752 | A1 * | 11/2006 | Lee | 315/291 |
| 2008/0111800 | A1 * | 5/2008 | Wang et al. | 345/204 |
| 2009/0109165 | A1 * | 4/2009 | Park et al. | 345/102 |

FOREIGN PATENT DOCUMENTS

| | | | |
|---|---|---|---|
| JP | 2002-190392 | A | 7/2002 |
| JP | 2008-130295 | A | 6/2008 |
| JP | 2009-211948 | A | 9/2009 |
| JP | 2009-266855 | A | 11/2009 |
| JP | 2010-067673 | A | 3/2010 |
| JP | 2010-086826 | A | 4/2010 |

(Continued)

*Primary Examiner* — Alexander S Beck
*Assistant Examiner* — Amen Bogale
(74) *Attorney, Agent, or Firm* — Cantor Colburn LLP

(57) ABSTRACT

A backlight unit includes a DC-DC converter; a voltage control unit which controls output voltage of the DC-DC converter; a plurality of unit light emitting diode arrays; and current deviation compensating unit in connection with input terminals of the plurality of unit light emitting diode arrays. The current deviation compensating unit receives the controlled voltage of the voltage control unit and transfers a feedback signal to the voltage control unit based on the received voltage, and actively compensates a current deviation generated by electrical characteristics of the plurality of unit light emitting diode arrays and transfers the compensated current deviation to the input terminals of the plurality of unit light emitting diode arrays.

20 Claims, 7 Drawing Sheets

(56) References Cited

FOREIGN PATENT DOCUMENTS

| | | | |
|---|---|---|---|
| KR | 10-2008-0023810 | A | 3/2008 |
| KR | 10-2008-0023811 | A | 3/2008 |
| KR | 10-2008-0023812 | A | 3/2008 |
| KR | 10-2009-0078525 | A | 7/2009 |
| KR | 10-2010-0047078 | A | 5/2010 |

* cited by examiner

BACK LIGHT UNIT AND DISPLAY DEVICE INCLUDING THE SAME

This application claims priority Korean Patent Application No. 10-2011-0031758 filed on Apr. 6, 2011, and all the benefits accruing therefrom under 35 U.S.C. §119, the entire contents of which are incorporated herein by reference.

BACKGROUND OF THE INVENTION 1. (a) Field of the Invention

The invention relates to a backlight unit including a current deviation compensating unit, and a display device.

2. (b) Description of the Related Art

As display devices, a flat panel display device with a small thickness has been a trend after a cathode-ray tube type display device and a projection type display device. The flat panel display device is manufactured by various methods and a representative example thereof is a liquid crystal display.

The liquid crystal display as a non-emissive display device includes a backlight unit as an essential component. The backlight unit has used a fluorescent lamp such as an existing cold cathode fluorescent lamp ("CCFL") and has used even a light emitting diode ("LED") having low power consumption and generating a small amount of heat, as a light source.

The LED is used by a unit of a unit LED array in which a plurality of small LEDs are arranged in series and several unit LED arrays are generally used in one backlight unit. Since the LEDs have different element characteristics (e.g., a resistance value, a voltage drop (Vf) value, and the like), although one unit LED array including the plurality of LEDs also includes the same number of LEDs, the unit LED arrays have different element characteristics (e.g., a whole voltage drop (Vf) value). If the LEDs do not emit light uniformly by controlling the different characteristics, a display quality of the display device deteriorates.

The above information disclosed in this Background section is only for enhancement of understanding of the background of the invention and therefore it may contain information that does not form the prior art that is already known in this country to a person of ordinary skill in the art.

BRIEF SUMMARY OF THE INVENTION

The invention provides a backlight unit including several unit light emitting diode arrays uniformly emitting light even though the unit light emitting diode arrays have different characteristics (a resistance or voltage drop (Vf) value), and a display device including the same.

An exemplary embodiment of the invention provides a backlight unit including: a DC-DC converter; a voltage control unit which controls output voltage of the DC-DC converter; a plurality of unit light emitting diode arrays; and a current deviation compensating unit in connection with input terminals of the plurality of unit light emitting diode arrays. The current deviation compensating unit receives the controlled voltage of the voltage control unit and transfers a feedback signal to the voltage control unit based on the received voltage. The current deviation compensating unit actively compensates a current deviation generated by electrical characteristics of the plurality of unit light emitting diode arrays and transfers the compensated current deviation to the input terminals of the plurality of unit light emitting diode arrays.

In an exemplary embodiment, the current deviation may be compensated based on a unit light emitting diode array having the largest voltage drop among the plurality of unit light emitting diode arrays.

In an exemplary embodiment, the current deviation compensating unit may include: a plurality of unit circuits in connection with the plurality of unit light emitting diode arrays, respectively; and a loop unit in common connection with the plurality of unit circuits.

In an exemplary embodiment, each of the unit circuits may include a unit circuit transistor and a unit circuit diode. An input terminal of the unit circuit transistor receives an input voltage from an input terminal of the current deviation compensating unit, an input terminal of the unit circuit transistor may be in connection with an anode of the unit circuit diode and an input terminal of the unit light emitting diode array, and a control terminal of the unit circuit transistor may be in connection with a first end of the loop unit, and a cathode of the unit circuit diode is in connection with an opposing second end of the loop unit.

In an exemplary embodiment, the loop unit may include a loop unit transistor. A control terminal of the loop unit transistor may be in connection with the cathode of the unit circuit diode, an input terminal of the loop unit transistor may be in connection with the control terminal of the unit circuit transistor, and an output terminal of the loop unit transistor may be grounded.

In an exemplary embodiment, the cathode of the unit circuit diode of each of the plurality of unit circuits may be in common connection with the control terminal of the loop unit transistor, and the control terminal of the unit circuit transistor of each of the plurality of unit circuits may be in common connection with the input terminal of the loop unit transistor.

In an exemplary embodiment, a reference loop may include a unit circuit diode of one of the unit circuits in connection with a unit light emitting diode array which has the largest voltage drop among the unit light emitting diode arrays. The one of the unit circuits is a reference unit circuit, the unit circuit diode of the one of the unit circuits is a reference diode, and the unit light emitting diode array which has the largest voltage drop is a reference unit light emitting diode array In an exemplary embodiment, a control loop including the loop unit and the reference unit circuit activates and controls the unit circuit transistors in unit circuits other than the reference unit circuit.

In an exemplary embodiment, one of the loop unit transistor and the unit circuit transistor may be a PNP transistor and the other may be an NPN transistor.

In an exemplary embodiment, the current deviation compensating unit may further include a constant current control unit between the plurality of unit circuits and the input terminal of the current deviation compensating unit. The constant current control unit may include a constant current control transistor. A control terminal of the constant current control transistor may receive a pulse width modulation ("PWM") signal from the voltage control unit, an input terminal of the constant current control transistor may transmit the feedback signal to the voltage control unit while receiving the input voltage of the current deviation compensating unit, and an output terminal of the constant current control transistor may be in common connection with the unit circuits.

In an exemplary embodiment, the constant current control transistor may be a p-MOS transistor.

In an exemplary embodiment, the plurality of unit light emitting diode arrays may be arranged on a side of the backlight unit.

Another exemplary embodiment of the invention provides a display device including: a display panel; a gate driver in connection with the display panel; a data driver in connection with the panel; a backlight unit which provides light to the display panel; and a signal controller in connection with the display panel, the gate driver, the data driver, and the backlight unit, and controlling the display panel, the gate driver, the data driver, and the backlight unit. The backlight unit includes a DC-DC converter; a voltage control unit which controls output voltage of the DC-DC converter; a plurality of unit light emitting diode arrays; and a current deviation compensating unit in connection with input terminals of the plurality of unit light emitting diode arrays. The current deviation compensating unit receives the controlled voltage of the voltage control unit and transfers a feedback signal to the voltage control unit based on the received voltage. The current deviation compensating unit actively compensates a current deviation generated by electrical characteristics of the plurality of unit light emitting diode arrays and transfers the compensated current deviation to the input terminals of the plurality of unit light emitting diode arrays.

In an exemplary embodiment, the current deviation may be compensated based on a unit light emitting diode array having the largest voltage drop among the plurality of unit light emitting diode arrays.

In an exemplary embodiment, the current deviation compensating unit may include: a plurality of unit circuits in connection with the plurality of unit light emitting diode arrays, respectively; and a loop unit in common connection with the plurality of unit circuits.

In an exemplary embodiment, each of the unit circuits may include a unit circuit transistor and a unit circuit diode. An input terminal of the unit circuit transistor receives an input voltage from an input terminal of the current deviation compensating unit, an input terminal of the unit circuit transistor may be in connection with an anode of the unit circuit diode and the input terminal of the unit light emitting diode array, and a control terminal of the unit circuit transistor may be in connection with a first end of the loop unit, and a cathode of the unit circuit diode is in connection with an opposing second end of the loop unit.

In an exemplary embodiment, the loop unit may include a loop unit transistor. A control terminal of the loop unit transistor may be in connection with the cathode of the unit circuit diode, an input terminal of the loop unit transistor may be in connection with the control terminal of the unit circuit transistor, and an output terminal of the loop unit transistor may be grounded.

In an exemplary embodiment, the cathode of the unit circuit diode of each of the plurality of unit circuits may be in common connection with the control terminal of the loop unit transistor, and the control terminal of the unit circuit transistor of each of the plurality of unit circuits may be in common connection with the input terminal of the loop unit transistor.

In an exemplary embodiment, the current deviation compensating unit may further include a constant current control unit between the plurality of unit circuits and the input terminal of the current deviation compensating unit. The constant current control unit may include a constant current control transistor. A control terminal of the constant current control transistor may receive a PWM signal from the voltage control unit, an input terminal of the constant current control transistor may transfer the feedback signal to the voltage control unit while receiving the input voltage of the current deviation compensating unit, and an output terminal of the constant current control transistor may be in common connection with the plurality of unit circuits.

In an exemplary embodiment, the plurality of unit light emitting diode arrays may be arranged on a side of the backlight unit.

According to exemplary embodiments of the invention, in a backlight unit, even though unit light emitting diode arrays have different voltage drop (Vf) values, it is possible to actively compensate a voltage drop difference by configuring circuit elements into a current mirror circuit. Further, according to exemplary embodiments of the invention, since the current mirror circuit can be manufactured by using only analog circuit elements, a manufacturing cost is low.

Furthermore, according to exemplary embodiments of the invention, in the backlight unit, a current deviation compensating unit and a feedback terminal are at an input terminal (hot side) of the unit light emitting diode array, and as a result, an output terminal (cold side) can be grounded. Therefore, wiring may be simplified in the backlight unit.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION OF THE INVENTION

Figure 1:
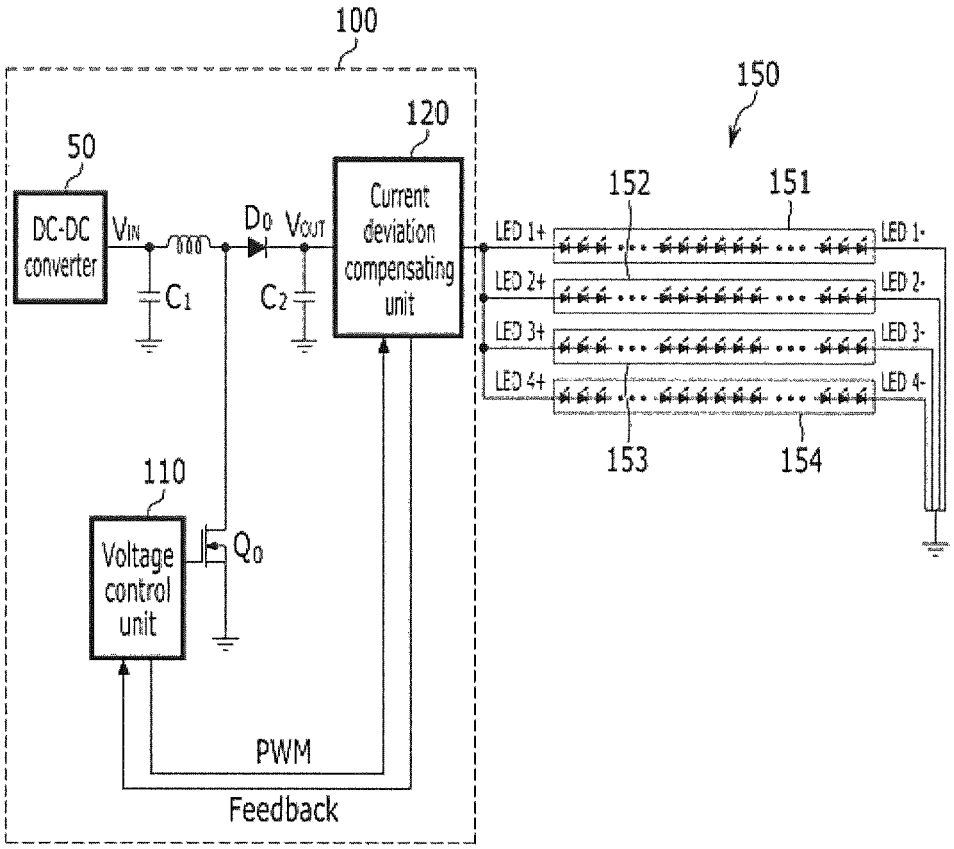
FIG. 1 is a block diagram of an exemplary embodiment of a backlight unit according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, "connected" indicates electrical and/or physical connection.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be described in detail with reference to the accompanying drawings.

According to an exemplary embodiment of the invention, a backlight unit includes a plurality of unit light emitting diode ("LED") arrays and a current deviation compensating unit in order to control the unit LED arrays to emit light with the same (alternatively, similar within a tolerance) luminance as each other even though the unit LED arrays have different characteristics (hereinafter, will be described based on a voltage drop (Vf) value).

In the exemplary embodiment of the invention, the current deviation compensating unit is connected to an input terminal (hot side) of the LED arrays through which current is inputted and feeds back a voltage/current characteristic in the current deviation compensating unit on the basis of the voltage/current characteristic to control a voltage/current value applied to the unit LED arrays. Since an output terminal (cold side) of the unit LED array may be grounded due to the current deviation compensating unit connected to the input terminal, wires may be formed and arranged simply.

Further, the current deviation compensating unit may actively compensate a difference in voltage drop (Vf) values among the unit LED arrays by using only simple analog elements such as a diode, a transistor, and a resistor. As a result, a complicated integrated circuit or a switch may not be used. (For reference, a manufacturing time and a manufacturing cost of the integrated circuit increase and the switch needs an operating space and a control unit, such that the circuit becomes complex.)

Hereinafter, exemplary embodiments of a backlight unit, and a display device including the same according to the invention will be described in detail with reference to the accompanying drawings.

FIG. 1 is a block diagram of an exemplary embodiment of a backlight unit according to the invention.

The backlight unit 200 according to the invention generally includes an LED controller 100 and a light source unit 150.

First, the light source unit 150 includes a plurality of LEDs, and the plurality of LEDs are classified into several groups, which include unit LED arrays 151, 152, 153, and 154, respectively. The unit LED arrays 151, 152, 153, and 154 may have a structure in which a plurality of LEDs are connected to each other in series. Each unit LED array includes a positive terminal and a negative terminal. As illustrated in FIG. 1, unit LED arrays 151, 152, 153, and 154 include positive terminals LED1+, LED2+, LED3+, LED4+, and negative terminals LED1−, LED2−, LED3− and LED4−, respectively.

Since the LEDs have different voltage drop (Vf) values, the unit LED arrays 151, 152, 153, and 154 respectively including the plurality of LEDs have different voltage drop (Vf) values.

However, since the backlight unit 200 should allow the unit LED arrays 151, 152, 153, and 154 to emit light uniformly in spite of the difference in the voltage drop (Vf) values, the backlight unit 200 includes a current deviation compensating unit 120 in the LED controller 100 which actively controls the current deviation compensating unit 120 in order to implement the uniform emission.

The LED controller 100 will be described. The LED controller 100 includes a direct current-to-direct current ("DC-DC") converter 50, a voltage control unit 110, the current deviation compensating unit 120, and elements (C1, C2, D0, Q0, a coil, and the like) respectively connecting them. Output voltage of the DC-DC converter 50 is stored as $V_{IN}$ in a capacitor C1 and inputted into an anode terminal of the diode $D_0$ through a coil. The anode terminal of the diode $D_0$ is connected to a ground through the transistor $Q_0$, and the transistor $Q_0$ is controlled according to a signal of the voltage control unit 110. As a result, the voltage inputted from the DC-DC converter 50 according to the signal of the voltage control unit 110 is transformed and applied to the anode terminal of the diode $D_0$, outputted to a cathode terminal of the diode $D_0$ and stored in a capacitor $C_2$ as voltage $V_{OUT}$. The voltage $V_{OUT}$ stored in the capacitor $C_2$ corresponds to input voltage of the current deviation compensating unit 120.

Therefore, when the LED controller 100 as the part that supplies voltage/current to the light source unit 150 to allow each LED to emit light boosts or lowers the voltage inputted from the DC-DC converter 50 by the signal of the voltage control unit 110 and applies the boosted or reduced voltage to the current deviation compensating unit 120, the current deviation compensating unit 120 applies a substantially similar current to each of the unit LED arrays 151, 152, 153, and 154 in the light source unit 150 within a tolerance, by using the applied voltage to display similar luminance with a difference that is not noticeable to a viewer.

Further, the current deviation compensating unit 120 and the voltage control unit 110 are connected to each other. The current deviation compensating unit 120 transfers a feedback signal to the voltage control unit 110, and the voltage control unit 110 transfers a pulse width modulation ("PWM") signal to the current deviation compensating unit 120 according to the feedback signal. As a result, the voltage control unit 110 boosts or lowers the voltage inputted from the DC-DC converter 50 to control the luminance of the light source unit 150 on the basis of the feedback signal from the current deviation compensating unit 120. In addition, the voltage control unit 110 may control the luminance of the light source unit 150 by controlling a duty ratio of the PWM signal on the basis of the feedback signal from the current deviation compensating unit 120.

An exemplary embodiment of the structure of the illustrated deviation compensating unit 120 will be described below in FIG. 4 and prior to that, exemplary embodiments of a plan view structure of the backlight unit 200 and a circuit structure of a display device according to a the invention will be described through FIGS. 2 and 3.

Figure 2:
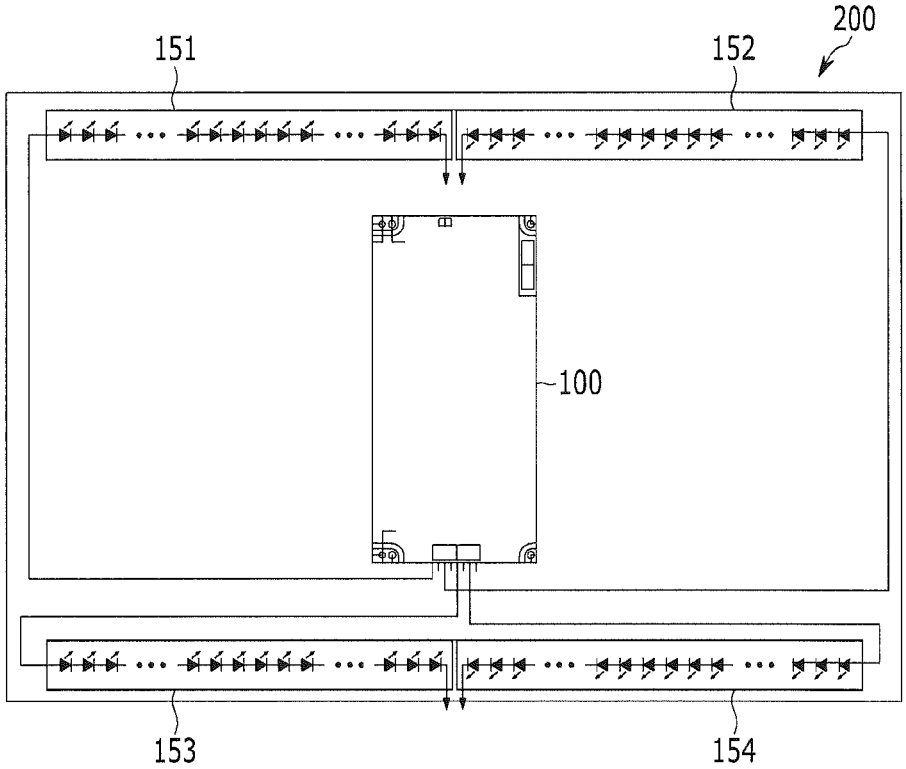
FIG. 2 is a plan view of another exemplary embodiment of a backlight unit according to the invention.
Figure 3:
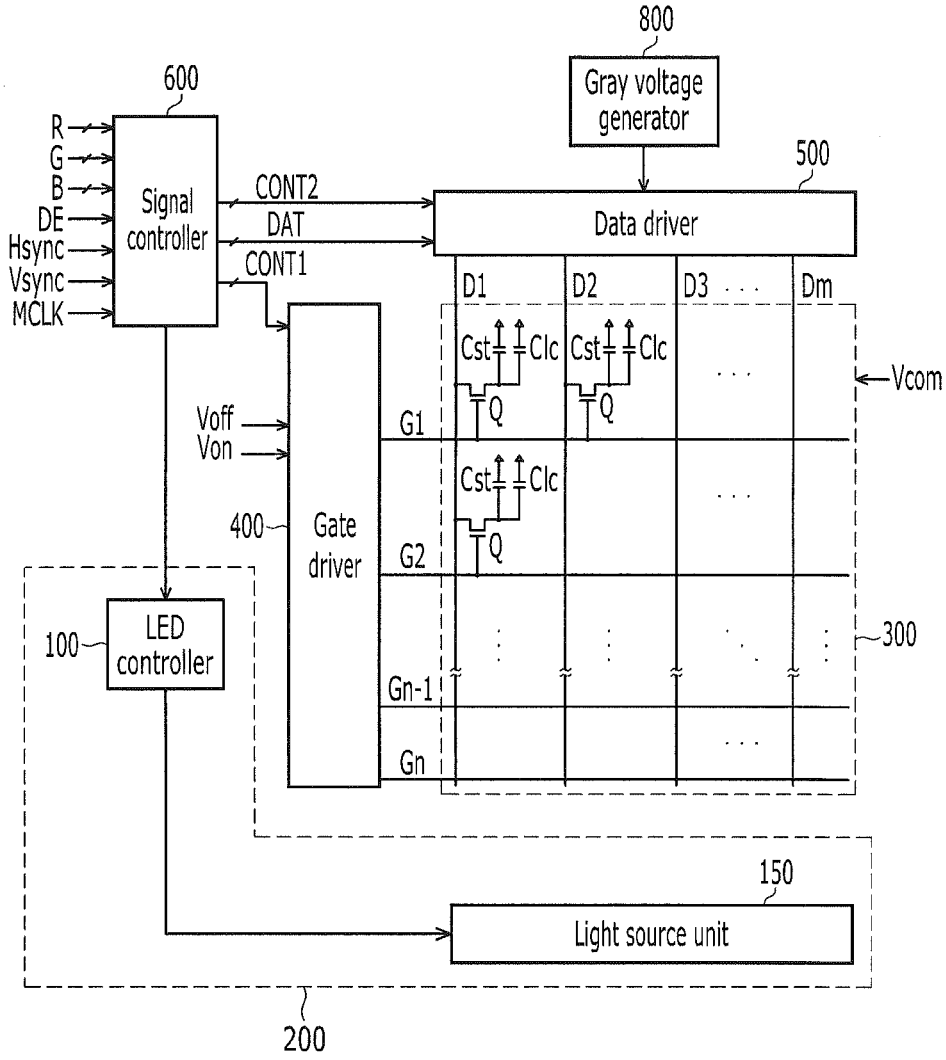
FIG. 3 is a block diagram of an exemplary embodiment of a display device according to the invention.

FIG. 2 is a plan view of an exemplary embodiment of a backlight unit according to the invention and FIG. 3 is a block diagram of an exemplary embodiment of a display device according to the invention.

As shown in FIG. 2, the backlight unit 200 according to the invention includes four (4) unit LED arrays 151, 152, 153, and 154 and the LED controller 100. The LED controller 100 includes one integrated circuit ("IC") (including a driving IC). The LED controller 100 is connected to input terminals (hot sides) of each of the unit LED arrays 151, 152, 153, and 154 through respective wires. Output terminals (cold sides) of each of the unit LED arrays 151, 152, 153, and 154 are grounded.

In the exemplary embodiment, the four unit LED arrays 151, 152, 153, and 154 are shown as an edge type backlight unit 200 in which two unit LED arrays are on each of both opposing long sides of the backlight unit 200. However, in some exemplary embodiments, the four unit LED arrays 151, 152, 153, and 154 may be a direct type backlight unit in which the unit LED arrays are on a short side or on an entire surface of the backlight unit.

In FIG. 3, the exemplary embodiment of the display device according to the invention is shown in a block structure, and the backlight unit 200 is turned on and off according to a control signal provided from a signal controller 600. The display device according to the invention includes a liquid crystal panel assembly (also referred to as a "display panel") 300, a gate driver 400, a data driver 500, a gray voltage generator 800, and the signal controller 600.

The exemplary embodiment of the display device according to the invention will be described below in brief.

The liquid crystal panel assembly 300 includes a plurality of signal lines G1 to Gn and D1 to Dm, a plurality of pixels connected thereto and arranged substantially in matrix when viewed as an equivalent circuit, and lower and upper panels facing each other and a liquid crystal layer interposed therebetween.

Each pixel includes a switching element Q connected to the signal lines G1 to Gn and D1 to Dm, respectively, and a liquid crystal capacitor Clc and a storage capacitor Cst connected thereto. The switching element Q is a three-terminal element such as a thin film transistor on the lower panel. A control terminal of the switching element Q is connected to the gate lines G1 to Gn, an input terminal is connected to the data lines D1 to Dm, and an output terminal is connected to the liquid crystal capacitor Clc and the storage capacitor Cst. At least one polarizer polarizing light is attached onto an outer surface of the liquid crystal panel assembly 300.

The gray voltage generator 800 generates two pairs of gray voltage sets associated with transmittance of the pixel. One of two pairs has a positive value and the other pair has a negative value with respect to common voltage Vcom.

The gate driver 400 is connected with the gate lines G1 to Gn of the liquid crystal panel assembly 300 and applies a gate signal including a combination of gate-on voltage Von and gate-off voltage Voff to the gate lines G1 to Gn.

The data driver 500 is connected with the data lines D1 to Dm of the liquid crystal panel assembly 300, and selects gray voltage from the gray voltage generator 800 and applies the selected gray voltage to the data lines D1 to Dm as a data signal.

The signal controller 600 controls the gate driver 400, the data driver 500, and the like. That is, the signal controller 600 receives input image signals R, G, and B, and input control signals controlling the display thereof from an external graphic controller (not shown). Examples of the input control signals include, but are not limited to, a vertical synchronization signal Vsync and a horizontal synchronization signal Hsync, a main clock MCLK, a data enable signal DE, and the like.

The signal controller 600 appropriately processes the input image signals R, G, and B according to an operational condition of the liquid crystal panel assembly 300 on the basis of the input image signals R, G, and B and the input control signals, and generates a gate control signal CONT1, a data control signal CONT2, and the like. Thereafter, the signal controller 600 sends out the gate control signal CONT1 to the gate driver 400, and the data control signal CONT2 and a processed image signal DAT to the data driver 500 to control the drivers of the display device.

In the exemplary embodiment, the unit LED arrays 151, 152, 153, and 154 should be controlled to emit light uniformly in spite of the difference in the voltage drop (Vf) values. The structure of the current deviation compensating unit 120 performing the control will be described through an exemplary embodiment shown in FIG. 4.

Figure 4:
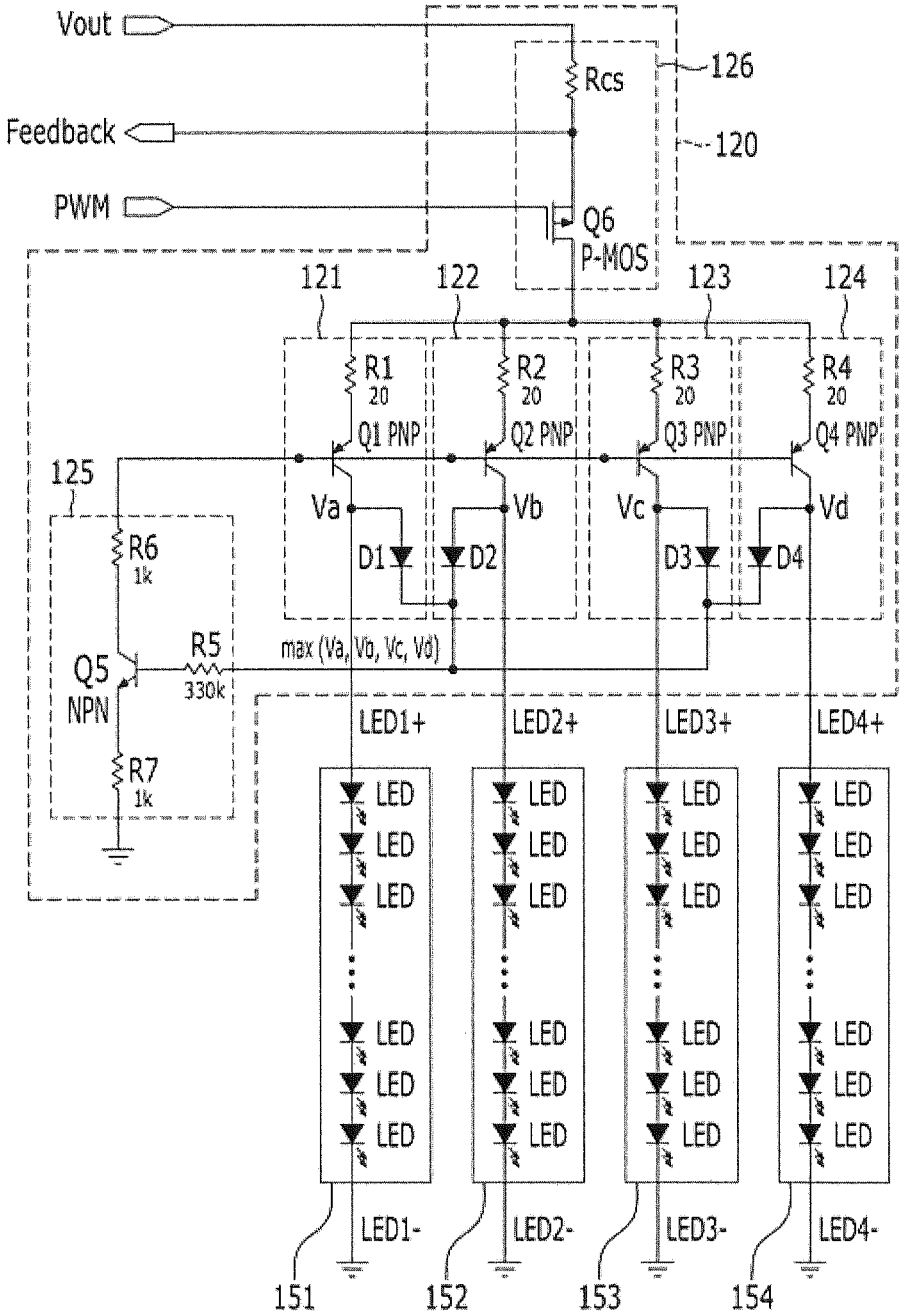
FIG. 4 is a circuit diagram of an exemplary embodiment of a current deviation compensating unit and a light source unit according to the invention.

FIG. 4 is a circuit diagram of an exemplary embodiment of a current deviation compensating unit and a light source unit according to the invention. The exemplary embodiment of the current deviation compensating unit 120 according to the invention includes transistors Q1, Q2, Q3, Q4, Q5, and Q6, diodes D1, D2, D3, and D4, and resistors R1, R2, R3, R4, R5, R6, R7, and Rcs. In the exemplary embodiment, the transistors Q1, Q2, Q3, and Q4 are PNP type transistors, the transistor Q5 is an NPN type transistor, and the transistor Q6 is a p-MOS transistor.

The current deviation compensating unit 120 includes a whole constant current control unit 126 which controls whole current applied to first to fourth unit circuits 121 to 124 through feedback, the first to fourth unit circuits 121 to 124, and a loop unit 125 maintaining the balance of the unit LED arrays. The whole constant current control unit 126 is between an input terminal of the current deviation compensating unit 120 and the first to fourth unit circuits 121 to 124.

First, the whole constant current control unit 126 includes the resistor Rcs and the transistor Q6. Herein, the transistor Q6 is also referred to as a 'constant current control transistor'.

Although the resistor Rcs may be a additional element of a separate resistor of the input terminal of the current deviation compensating unit 120, the resistor Rcs may represent the input terminal's own resistance.

An input terminal of the transistor Q6 is connected with the resistor Rcs of the input terminal of the current deviation compensating unit 120 and a feedback terminal of the voltage control unit 110, and a control terminal of the transistor Q6 is connected with a PWM signal terminal of the voltage control unit 110. An output terminal of the transistor Q6 is connected with input terminals of the first to fourth unit circuits 121 to 124.

The transistor Q6 performs a PWM dimming control and senses current (alternatively, voltage) to transfer the sensed current (alternatively, voltage) to the voltage control unit 110 as the feedback signal. As a result, the transistor Q6 controls the whole constant current applied to the current deviation compensating unit 120 and is a core element of the constant current control unit 126. That is, the transistor Q6 receives the PWM signal from the voltage control unit 110 through the control terminal thereof and operates according to the duty ratio of the PWM signal to transfer the voltage applied to the input terminal of the current deviation compensating unit 120 to the first to fourth unit circuits 121 to 124 or interrupt the voltage. In this case, the current (or voltage) at the input terminal side of the transistor Q6 is transferred to the voltage control unit 110 as the feedback signal. The voltage control unit 110 receiving the feedback signal boosts/lowers the voltage received from the DC-DC converter 50 or changes the duty ratio of the PWM signal on the basis of the feedback signal to control the luminance of the light source unit 150.

The voltage applied through the transistor Q6 is transferred to the input terminals of the first to fourth unit circuits 121 to 124.

The first to fourth unit circuits 121 to 124 have the same configuration as each other and the configuration will be described below. The first unit circuit 121 includes the resistor R1, the transistor Q1, and the diode D1 and is connected with the first unit LED array 151, the second unit circuit 122 includes the resistor R2, the transistor Q2, and the diode D2 and is connected with the second unit LED array 152, the third unit circuit 123 includes the resistor R3, the transistor Q3, and the diode D3 and is connected with the third unit LED array 153, and the fourth unit circuit 124 includes the resistor R4, the transistor Q4, and the diode D4 and is connected with the fourth unit LED array 154. Herein, each of the resistors R1, R2, R3, and R4 may be an additional element of a separate resistor of the input terminal of each unit circuit, and/or may represent the input terminal's own resistance. Further, the transistors Q1, Q2, Q3, and Q4 are referred to as 'unit circuit transistors'.

In addition, first ends of the resistors R1, R2, R3, and R4 are commonly connected with the output terminal (one end of the constant current control unit 126) of the transistor Q6 to form the input terminals of the first to fourth unit circuits 121 to 124, and cathodes of the diodes D1, D2, D3, and D4 are commonly connected with a control terminal (one end of the loop unit 125) of the transistor Q5 through the resistor R5.

The structure of the first unit circuit 121 will be primarily described in detail below. The output terminal of the transistor Q6 is connected with the first end of the resistor R1 of the first unit circuit 121 (hereinafter, also referred to as the input terminal of the first unit circuit 121) and an opposing second end of the resistor R1 is connected with the input terminal of the transistor Q1. An output terminal of the transistor Q1 is an output terminal of the first unit circuit 121 and is connected with both the input terminal (hot side) of the first unit LED array 151 and an anode of the diode D1. The cathode of the diode D1 and a control terminal of the transistor Q1 are connected with different ends of the loop unit 125, respectively. That is, the cathode of the diode D1 is connected with a control terminal of the transistor Q5 through the resistor R5 of the loop unit 125, and the control terminal of the transistor Q1 is connected with an input terminal of the transistor Q5 through the resistor R6 of the loop unit 125. As a result, the first unit circuit 121 and the loop unit 125 form one loop (hereinafter, referred to as a first loop) and the first loop is defined by the transistors Q1 and Q5, the diode D1, and the resistors R5 and R6. More specifically, the first loop is defined in a sequential route of the control terminal of the transistor Q5 → the input terminal of the transistor Q5 → the resistor R6 → the control terminal of the transistor Q1 → the output terminal of the transistor Q1 → the diode D1 → the resistor R5.

The second unit circuit 122 also has the same configuration as the first unit circuit 121 and a second loop formed with the loop unit 125 includes the transistors Q2 and Q5, the diode D2, and the resistors R5 and R6. More specifically, the second loop is defined by a sequential route of the control terminal of the transistor Q5 → the input terminal of the transistor Q5 → the resistor R6 → the control terminal of the transistor Q2 → the output terminal of the transistor Q2 → the diode D2 → the resistor R5.

Further, a third loop formed by the third unit circuit 123 and the loop unit 125 includes the transistors Q3 and Q5, the diode D3, and the resistors R5 and R6, and a fourth loop formed by the fourth unit circuit 124 and the loop unit 125 includes the transistors Q4 and Q5, the diode D4, and the resistors R5 and R6. More specifically, the third loop is defined by a sequential route of the control terminal of the transistor Q5 → the input terminal of the transistor Q5 → the resistor R6 → the control terminal of the transistor Q3 → the output terminal of the transistor Q3 → the diode D3 → the resistor R5, and the fourth loop is defined by a sequential route of the control terminal of the transistor Q5 → the input terminal of the transistor Q5 → the resistor R6 → the control terminal of the transistor Q4 → the output terminal of the transistor Q4 → the diode D4 → the resistor R5.

Therefore, the cathodes of the diodes D1, D2, D3, and D4 of the first to fourth unit circuits 121 to 124 are commonly connected with the control terminal of the transistor Q5 through the resistor R5 to form the first to fourth loops, respectively, and have an OR circuit structure in which current flows on only one of the four loops. That is, only a loop through which the largest current flows among the first to fourth loops, forms a closed loop.

The loop unit 125 includes the transistor Q5, and the resistors R5, R6, and R7. Herein, the transistor Q5 is also referred to as a 'loop unit transistor'. The control terminal of the transistor Q5 is connected with the cathode (one end of each of the first to fourth unit circuits 121 to 124) of each of the diodes D1, D2, D3, and D4 through the resistor R5, the output terminal is grounded through the resistor R7, and the input terminal is connected with the control terminals (the ends of the first to fourth unit circuits 121 to 124) of the transistors Q1, Q2, Q3, and Q4 through the resistor R6. Herein, the resistors R5, R6, and R7 may be additional separate resistors, but may represent the wires' own resistances.

Through the above-described structure, the first to fourth unit circuits 121 to 124 and the loop unit 125 collectively form an active current mirror circuit. Herein, the active current mirror circuit selectively operates one of the first to fourth loops actively according to a circuit condition.

All the input terminals of the first to fourth unit circuits 121 to 124 receive the same voltage. However, different currents may flow to the unit LED arrays 151 to 154 due to voltage drop (Vf) values of the unit LED arrays 151 to 154 which may be different from each other. As such, when the unit LED arrays 151 to 154 have the different voltage drop (Vf) values, the active current mirror circuit is connected to the input terminal (hot side) of each of the unit LED arrays 151 to 154 in order to reduce or effectively prevent the unit LED arrays 151 to 154 from emitting light with different luminances due to different currents which flow through the unit LED arrays 151 to 154.

When the unit LED arrays 151 to 154 have the different voltage drop (Vf) values, the active current mirror circuit is pulled down through only one diode through which the largest current flows (alternatively, the largest voltage is applied to the anode of any one of the diodes D1, D2, D3, and D4) among the diodes D1, D2, D3, and D4 to form the loop. That is, since all the cathodes of the diodes D1, D2, D3, and D4 are connected to the resistor R5, the cathodes have the same voltage, the largest current flows through the corresponding diode when the voltage of the corresponding diode is highest based on only the voltage at the anode, and the corresponding diode becomes a reference diode. In this case, a transistor connected with the reference diode is referred to as a reference transistor, the corresponding unit circuit is referred to as a reference unit circuit, a unit LED array connected therewith is referred to as a reference unit LED array, and a loop including the reference diode and the reference transistor is referred to as a reference loop.

When a closed loop of the reference circuit which connects the reference diode, the transistor Q5 and the reference transistor is formed, even with the potential loops of the remaining three unit circuits excluding the reference unit circuit, it is the resistor R6 of the loop unit 125 and the control terminal of the reference transistor which are connected with each other, and as a result, the reference transistor operates according to a characteristic of the loop unit 125.

That is, the current that flows on the reference diode turns on the transistor Q5 through the resistor R5, and as a result, the respective transistors Q1, Q2, Q3, and Q4 of the first to fourth unit circuits 121 to 124 are also turned on. Since the respective transistors Q1, Q2, Q3, and Q4 of all the first to fourth unit circuits 121 to 124 are turned on by the same control signal (the voltage of the resistor R6) and the same voltage is applied from the output terminal of the transistor Q6, the transistors Q1, Q2, Q3, and Q4 have the same output, such that all the currents applied to the unit LED arrays 151 to 154 may be the same as each other. However, some errors may occur according to characteristics of the transistor and the element.

Therefore, in the exemplary embodiment of the active current mirror circuit according to the invention, the reference diode is automatically selected according to the current (alternatively, voltage) applied to the diodes D1, D2, D3, and D4 of the first to fourth unit circuits and the reference loop is formed, and the unit circuits other than the reference loop are activated and receive the same control signal (the voltage at one end of the resistor R6) from the loop unit 125. As a result, although the unit LED arrays 151 to 154 have the different voltage drop (Vf) values, constant current is applied to all the unit LED arrays 151 to 154 to allow all the unit LED arrays 151 to 154 to have the same luminance within a predetermined range.

Therefore, the exemplary embodiment of the current deviation compensating unit 120 according to the invention may compensate a current deviation generated due to the difference in the voltage drop (Vf) values among the unit LED arrays 151 to 154 of the light source unit 150 by using only an analog circuit element as shown in FIG. 4.

Herein, the reference diode through which the largest current flows among the diodes D1, D2, D3, and D4 or of which the anode receives the largest voltage among the anodes of the diodes D1, D2, D3, and D4, represents the diode connected to the unit LED array having the largest voltage drop (Vf) value among the first to fourth unit LED arrays 151 to 154. Therefore, since the unit LED array having the largest voltage drop (Vf) value becomes the reference unit LED array, automatic feedback to the voltage control unit 110 is made so that all of the transistors Q1, Q2, Q3, and Q4 are activated and the same current is applied to all the unit LED arrays within an error range. Since all operations are performed at the input terminals (hot sides) of the unit LED arrays, the output terminals (cold sides) may be grounded.

Hereinafter, a result of testing whether the current deviation compensating unit 120 operates appropriately will be described through FIGS. 5 and 6.

Figure 5:
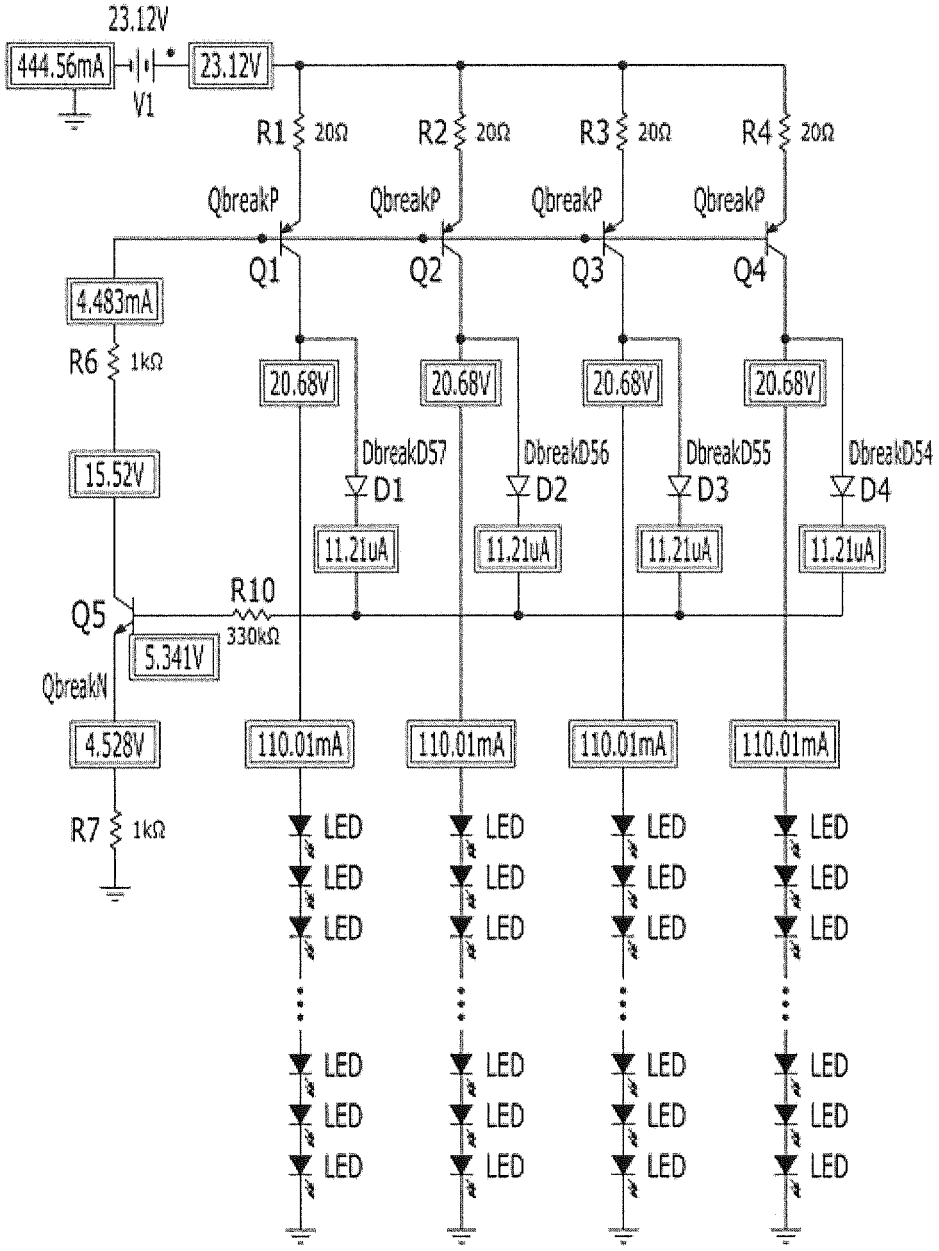
FIGS. 5 and 6 are diagrams showing results of testing an exemplary embodiment of a current deviation compensating unit according to the invention.
Figure 6:
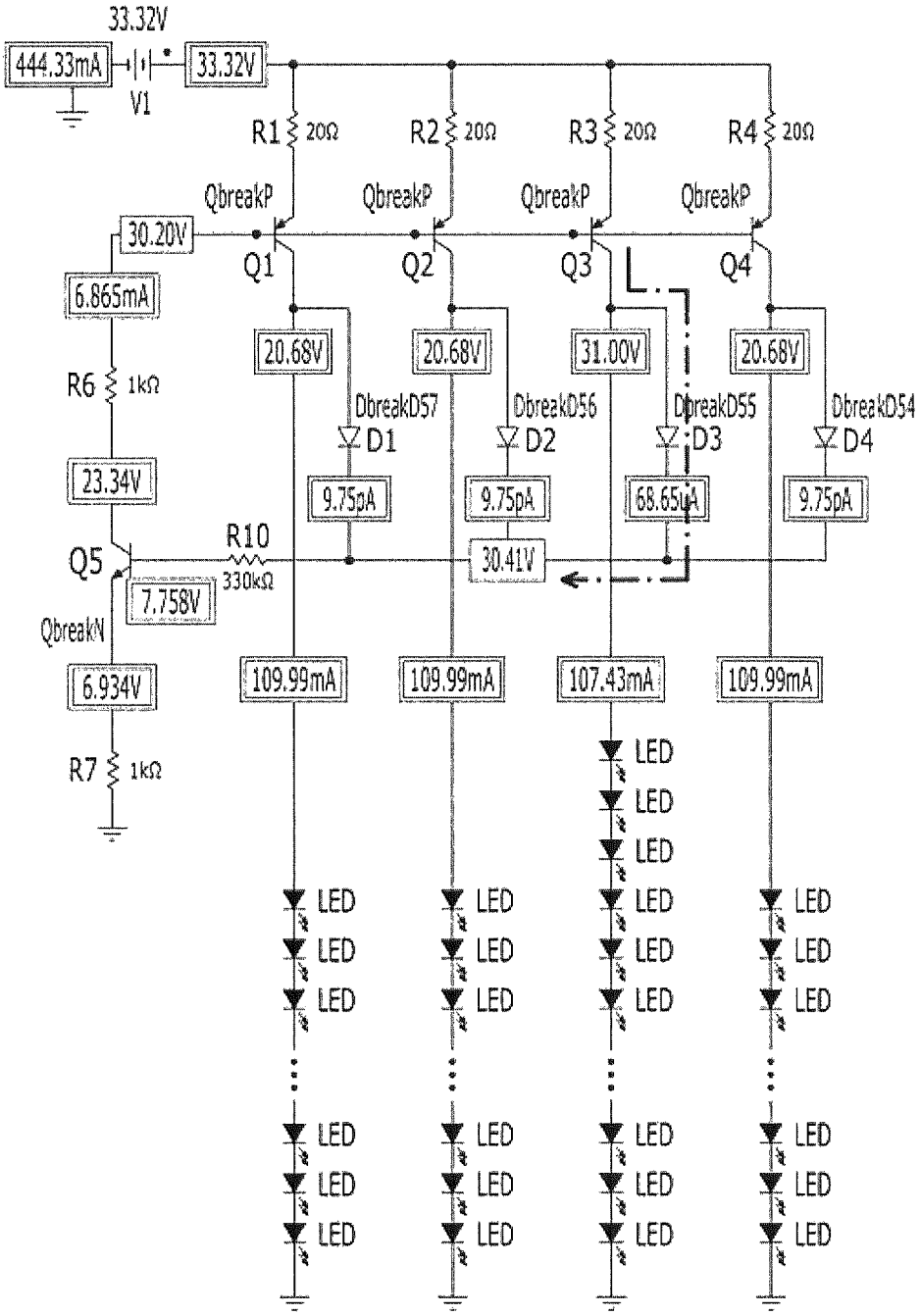

FIGS. 5 and 6 are diagrams showing a result of testing an exemplary embodiment of a current deviation compensating unit according to the invention.

First, in FIG. 5, a test result on the basis of a case in which all the unit LED arrays 151 to 154 include the same number of LEDs is shown.

A numerical electrical value of each element is shown in FIG. 5 and all the LEDs have the same voltage drop (Vf) values. Further, the test is performed on the basic assumption that this circuit is driven at constant current on the basis of all the currents applied to four unit LED arrays. That is, simulation is performed on the assumption of a feedback design in which whole constant current driving is possible so that 110 milliamps (mA) flows on each of the unit LED arrays.

As shown in FIG. 5, since all the unit LED arrays 151 to 154 have the same voltage drop (Vf) value, voltage of 20.68 volts (V) is applied to all the anode terminals of the diodes D1, D2, D3, and D4, such that a predetermined one of the diodes D1 to D4 is selected as the reference diode to configure the loop. As a result, 110.01 mA is applied similarly to all the unit LED arrays 151 to 154, which emit light with substantially the same luminance. In this case, voltage inputted into the current deviation compensating unit 120 is 23.12 V.

In FIG. 6, a case in which the third unit LED array 153 among the unit LED arrays 151 to 154 includes an additional LED, and has large voltage drop (Vf) and receives high voltage is shown. In FIG. 6, the third unit LED array is formed so that voltage drop (Vf) of approximately 8-9 V is further generated and the test is performed.

In FIG. 6, although it is assumed that the number of the LEDs is controlled and all the LEDs have the same voltage drop (Vf) value, the LEDs have different voltage drop (Vf) values. Therefore, one unit LED array may be extensively applied even in the case in which one unit LED array has a larger voltage drop (Vf) value than other unit LED arrays when the LEDs have the different voltage drop (Vf) values.

Referring to the test result of FIG. 6, it can be verified that the highest voltage (31.00 V) is applied to the anode of the diode D3 of the third unit circuit 123 connected with the third unit LED array 153. A lower 20.68 V is applied to the anodes of other diodes D1, D2, and D4. Therefore, the largest current (68.65 microamps (uA)) flows through the diode D3 and the diode D3 becomes the reference diode. A loop (third loop) is formed including the reference diode D3 (see an arrow of FIG. 6), and as a result, the respective transistors Q1, Q2, Q3, and Q4 of the first to fourth unit circuits 121 to 124 generate the same output current as the inputted voltage 33.32 V, and apply the generated output current to each of the unit LED arrays 151 to 154. In FIG. 6, currents applied to the unit LED arrays 151 to 154 are a little different. That is, 107.43 mA is applied to only the third unit LED array 153 and 109.99 mA is applied to the other unit LED arrays. The current difference represents a current loss generated while configuring a reference loop circuit and is within 5%, and as a result, the difference cannot be viewed through human eyes.

Therefore, although the unit LED arrays have different voltage drop (Vf) values, it is possible to actively compensate the difference with the exemplary embodiment of the active current mirror circuit according to the invention.

Figure 7:
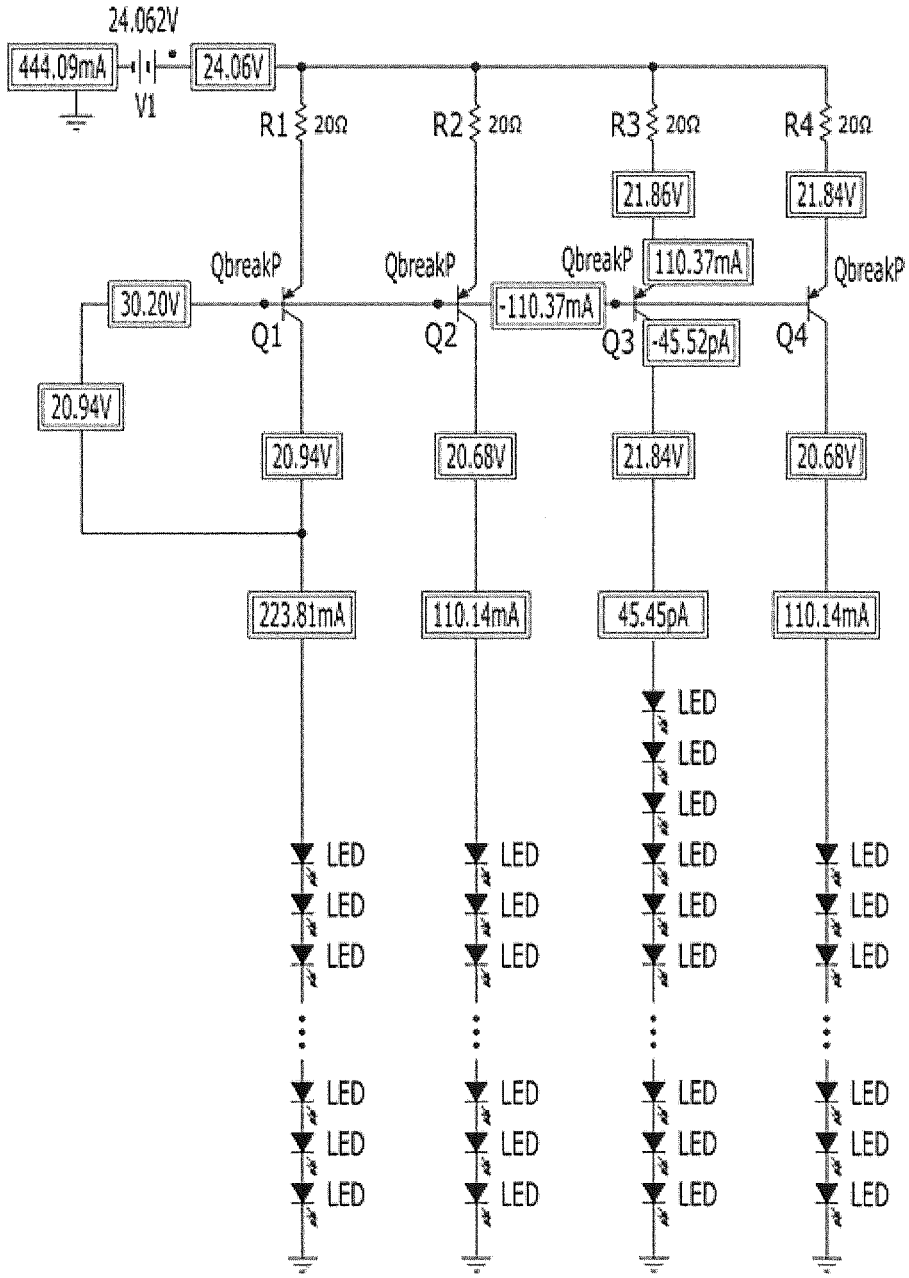
FIG. 7 is a diagram showing a result of testing a comparative example with respect to an exemplary embodiment of the invention.

In FIG. 7, a case in which the reference loop is fixed to the first unit circuit for comparison with the exemplary embodiment of the invention, is manufactured and tested.

FIG. 7 is a diagram showing a result of testing a comparative example with respect to an exemplary embodiment of the invention.

The comparative example of FIG. 7 shows a case in which the reference loop is fixed to the first loop and the third unit LED array has the large voltage drop (Vf) value.

According to FIG. 7, the loop is formed on the basis of the first unit circuit 121 and the change of the third unit LED array cannot be controlled. As a result, current with a large difference is applied to each unit LED array. That is, 223.81 mA is applied to the first unit LED array 151, 110.14 mA is applied to the second and fourth unit LED arrays 152 and 154, and 45.45 picoamps (pA) is applied to the third unit LED array 153. As a result, the third unit LED array 153 has luminance which is much lower than the first unit LED array 151.

That is, as shown in FIG. 7, when the reference loop is specified, in the case in which a unit LED array having the larger voltage drop (Vf) value than that of the reference unit LED array exists, a transistor in a unit circuit connected to the corresponding unit LED array enters a saturated region. Therefore, desired current cannot flow on the transistor, which deviates from a control area. As a result, most of current inputted into the transistor Q3 of FIG. 7 is outputted through the control terminal and only very low current (45.45 pA) is outputted through the output terminal.

Even in FIG. 7, if the unit LED array (the first unit LED array 151) connected with the first unit circuit 121 which is the reference unit circuit has the largest voltage drop (Vf) value, the result of FIG. 6 may occur, but a change of a characteristic (e.g., resistance or voltage drop (Vf)) occurs in the unit LED array which is not the reference unit LED array. Thus, when the corresponding unit LED array has a larger voltage drop (Vf) value, the voltage drop cannot be compensated. Therefore, in the invention, the active current mirror circuit is developed in order to remove the problem.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A backlight unit, comprising:

a DC-DC converter;

a voltage control unit which controls output voltage of the DC-DC converter;

a plurality of unit light emitting diode arrays; and a current deviation compensating unit including a plurality of unit circuits in connection with input terminals of the plurality of unit light emitting diode arrays, respectively, wherein the current deviation compensating unit:

receives the controlled voltage of the voltage control unit and transfers a feedback signal to the voltage control unit based on the received voltage, and actively compensates a current deviation generated by electrical characteristics of the plurality of unit light emitting diode arrays and transfers the compensated current deviation to the input terminals of the plurality of unit light emitting diode arrays, each of the plurality of unit circuits includes a unit circuit transistor and a unit circuit diode, and an input terminal of the unit circuit transistor receives an input voltage from an input terminal of the current deviation compensating unit, an output terminal of the unit circuit transistor is in direct connection with an anode of the unit circuit diode and an input terminal of a unit light emitting diode array.

2. The backlight unit of claim 1, wherein:

the current deviation is compensated based on a unit light emitting diode array having the largest voltage drop among the plurality of unit light emitting diode arrays.

3. The backlight unit of claim 2, wherein:

the current deviation compensating unit further includes a loop unit in common connection with the plurality of unit circuits.

4. The backlight unit of claim 3, wherein:

each of the unit circuits further includes a control terminal of the unit circuit transistor in connection with a first end of the loop unit, and a cathode of the unit circuit diode is in connection with the opposing second end of the loop unit.

5. The backlight unit of claim 4, wherein:

the loop unit includes a loop unit transistor, and a control terminal of the loop unit transistor is in connection with the cathode of the unit circuit diode, an input terminal of the loop unit transistor is in connection with the control terminal of the unit circuit transistor, and an output terminal of the loop unit transistor is grounded.

6. The backlight unit of claim 5, wherein:

the cathode of the unit circuit diode of each of the plurality of unit circuits is in common connection with the control terminal of the loop unit transistor, and the control terminal of the unit circuit transistor of each of the plurality of unit circuits is in common connection with the input terminal of the loop unit transistor.

7. The backlight unit of claim 6, wherein:

a reference loop includes a unit circuit diode of one of the unit circuits in connection with a unit light emitting diode array which has the largest voltage drop among the unit light emitting diode arrays, and the one of the unit circuits is a reference unit circuit, the unit circuit diode of the one of the unit circuits is a reference diode, and the unit light emitting diode array which has the largest voltage drop is a reference unit light emitting diode array.

8. The backlight unit of claim 7, wherein:

a control loop including the loop unit and the reference unit circuit, activates and controls the unit circuit transistors in unit circuits other than the reference unit circuit.

9. The backlight unit of claim 6, wherein:

one of the loop unit transistor and the unit circuit transistor is a PNP transistor and the other is an NPN transistor.

10. The backlight unit of claim 3, wherein:

the current deviation compensating unit further includes a constant current control unit between the plurality of unit circuits and the input terminal of the current deviation compensating unit, the constant current control unit includes a constant current control transistor, and a control terminal of the constant current control transistor receives a pulse width modulation signal from the voltage control unit, an input terminal of the constant current control transistor transmits the feedback signal to the voltage control unit while receiving the input voltage of the current deviation compensating unit, and an output terminal of the constant current control transistor is in common connection with the plurality of unit circuits.

11. The backlight unit of claim 10, wherein:

the constant current control transistor is a p-MOS transistor.

12. The backlight unit of claim 3, wherein:

the plurality of unit light emitting diode arrays are arranged on a side of the backlight unit.

13. A display device, comprising:

a display panel;

a gate driver in connection with the display panel;

a data driver in connection with the display panel;

a backlight unit in connection with the display panel, wherein the backlight unit provides light to the display panel; and a signal controller in connection with the display panel, the gate driver, the data driver, and the backlight unit, wherein the signal controller controls the display panel, the gate driver, the data driver, and the backlight unit, wherein the backlight unit includes, a DC-DC converter;

a voltage control unit which controls output voltage of the DC-DC converter;

a plurality of unit light emitting diode arrays; and a current deviation compensating unit including a plurality of unit circuits in connection with input terminals of the plurality of unit light emitting diode arrays, respectively, wherein the current deviation compensating unit receives the controlled voltage of the voltage control unit and transfers a feedback signal to the voltage control unit based on the received voltage, and actively compensates a current deviation generated by electrical characteristics of the plurality of unit light emitting diode arrays and transfers the compensated current deviation to the input terminals of the plurality of unit light emitting diode arrays, each of the plurality of unit circuits includes a unit circuit transistor and a unit circuit diode, and an input terminal of the unit circuit transistor receives an input voltage from an input terminal of the current deviation compensating unit, an output terminal of the unit circuit transistor is in direct connection with an anode of the unit circuit diode and an input terminal of the unit light emitting diode array.

14. The display device of claim 13, wherein:

the current deviation is compensated based on a unit light emitting diode array having the largest voltage drop among the plurality of unit light emitting diode arrays.

15. The display device of claim 14, wherein:

the current deviation compensating unit further includes: a loop unit in common connection with the plurality of unit circuits.

16. The display device of claim 15, wherein:

each of the unit circuits further includes a control terminal of the unit circuit transistor in connection with a first end of the loop unit, and a cathode of the unit circuit diode is in connection with an opposing second end of the loop unit.

17. The display device of claim 16, wherein:

the loop unit includes a loop unit transistor, and a control terminal of the loop unit transistor is in connection with the cathode of the unit circuit diode, an input terminal of the loop unit transistor is in connection with the control terminal of the unit circuit transistor, and an output terminal of the loop unit transistor is grounded.

18. The display device of claim 17, wherein:

the cathode of the unit circuit diode of each of the plurality of unit circuits is in common connection with the control terminal of the loop unit transistor, and the control terminal of the unit circuit transistor of each of the plurality of unit circuits is in common connection with the input terminal of the loop unit transistor.

19. The display device of claim 15, wherein:

the current deviation compensating unit further includes a constant current control unit between the plurality of unit circuits and the input terminal of the current deviation compensating unit, the constant current control unit includes a constant current control transistor, and a control terminal of the constant current control transistor receives a pulse width modulation signal from the voltage control unit, an input terminal of the constant current control transistor transmits the feedback signal to the voltage control unit while receiving the input voltage of the current deviation compensating unit, and an output terminal of the constant current control transistor is in common connection with the plurality of unit circuits.

20. The display device of claim 15, wherein:

the plurality of unit light emitting diode arrays are arranged on a side of the backlight unit.

* * * * *